US005211251A

United States Patent [19]

Woolslayer

[11] Patent Number: 5,211,251

[45] Date of Patent: May 18, 1993

[54] APPARATUS AND METHOD FOR MOVING TRACK GUIDED EQUIPMENT TO AND FROM A TRACK

[75] Inventor: Joseph R. Woolslayer, Tulsa, Okla.

[73] Assignee: Woolslayer Companies, Inc., Tulsa, Okla.

[21] Appl. No.: 869,799

[22] Filed: Apr. 16, 1992

[51] Int. Cl.[5] ..... E21B 19/00

[52] U.S. Cl. ..... 175/85; 175/52; 175/195; 175/203

[58] Field of Search ..... 175/52, 85, 195, 203, 175/161; 52/112; 173/28, 42, 44, 193

[56] References Cited

U.S. PATENT DOCUMENTS

| | | | |
|---|---|---|---|
| 3,708,024 | 1/1973 | Back | 175/52 |
| 3,835,940 | 9/1974 | Winter, Jr. | 175/85 |
| 4,351,398 | 9/1982 | Prins et al. | 173/104 |
| 4,421,179 | 12/1983 | Boyadjieff | 173/44 |
| 4,437,524 | 3/1984 | Boyadjieff et al. | 173/43 |
| 4,753,300 | 6/1988 | Shaw et al. | 175/85 X |
| 5,038,871 | 8/1991 | Dinsdale | 175/52 |

OTHER PUBLICATIONS

Lee C. Moore Corporation Drawing No. YK62166-6, dated Feb. 4, 1988.

*Primary Examiner*—Stephen J. Novosad

*Attorney, Agent, or Firm*—Dougherty, Hessin, Beavers & Gilbert

[57] ABSTRACT

Apparatus and method for moving the top drive of a top drive subterranean drilling system from the drilling track extending along the length of the derrick includes a movable working track, a secondary track pivotably connected to the working track, and a power assembly. The working track is connected to the derrick and is transversely movable between a first position in which the working track is aligned with the drilling track and a second position in which the working track is transversely displaced from alignment with the drilling track. The secondary track is pivotable between a skewed position in which the secondary track is not transversely coplanar with the drilling track and working track and an in-line position in which the secondary track is about transversely coplanar with the drilling track and the working track. The secondary track is transversely movable with the working track so that the secondary track is aligned with the drilling track when the working track is in the second position. The power assembly pivots the secondary track from the skewed position to the in-line position and transversely moves the secondary track in the in-line position and the working track to the second position of the working track to align the secondary track with the drilling track; and reverses the sequence to return the working track to alignment with the drilling track.

20 Claims, 8 Drawing Sheets

APPARATUS AND METHOD FOR MOVING TRACK GUIDED EQUIPMENT TO AND FROM A TRACK

BACKGROUND OF THE INVENTION

This invention relates to track guided drilling equipment and, more particularly, to method and apparatus for moving track guided equipment to and from a track, such as the drilling track extending on the derrick of a subterranean drilling rig.

The top drive drilling system is a relatively recent innovation in rotary drilling. Rather than using a rotary table and kelly to rotate the drill string, as did prior subterranean drilling systems, the top drive drilling system uses a top drive which is connected to the top of the drill string and which may travel vertically with the drill string. The top drive is suspended from the traveling block and swivel and includes a carriage which connects the top drive to a drilling track which extends vertically along the derrick. The track and carriage both guide the top drive and resist the torque created by the top drive drilling motor during drilling.

The top drive is a heavy and expensive piece of equipment. It is required while drilling the well, but it is not needed in the hoisting system when the drill string and bit are being tripped in or out of the well. The top drive may be left in the hoisting system during tripping operations, although doing so causes unnecessary loading and wear on the top drive and the hoisting system. It is therefore advantageous to move the top drive from the hoisting system during tripping operations. There are also other reasons for removing the top drive from the drilling track, drill string, and hoisting system. For example, during service and maintenance of the top drive, it may be desirable to install a replacement top drive on the drilling track or to revert to conventional drilling equipment (rotary table, kelly, etc.).

When the top drive is removed from the drilling track, it is important to move it to a location where it does not interfere with the tripping or other operations taking place on the derrick floor. Normally the well center (the longitudinal axis of the well) is the hub of all activities on the derrick floor and it is desirable to keep the area around the well center as clear as possible. It is typical for a top drive drilling system to require an envelope of unobstructed space which extends along the longitudinal axis of the well center. For example, one top drive drilling system known to the inventors requires an envelope of unobstructed space which extends (as viewed from the front, i.e., the opposite side of well center from the drilling track) 2 feet forward of well center, 4 feet behind well center, and 3.5 feet left and right of well center, and which also extends 2 feet forward of well center and 2 feet behind well center from well center to the derrick on the right side of well center. The envelope circumscribing the well center is needed to allow the top drive and hoisting equipment to travel up and down over well center. The clear area extending to the right side of the derrick is needed for the service lines (mud line, air line, electrical power line, etc.) which travel up and down with the top drive (and also with the swivel of a conventional drilling rig). The area to the right of well center should also be kept clear when the casing stabbing board and air hoist lines are in this area. Normally the driller stands at a console on the derrick floor to the left of well center. The driller requires an unobstructed view extending from the console to well center at approximately ten feet above the racking platform in the derrick.

Apparatus for removing the top drive from the drilling track and hoisting system are known. For example, the assignee of the present invention in 1988 designed such a system. The assignee's prior system moved the top drive laterally relative to the axis of the well to a storage position. In the assignee's prior system, the top drive was lowered onto a guide track at the lower end of the drilling track; and the guide track and top drive were moved laterally relative to the axis of the well on a laterally extending track to an offset position in which the guide track was aligned with a storage track. The top drive was then lifted onto the storage track (which extended above the guide track). The storage track was then pivoted into a storage position where the top drive was supported in a position offset from the well axis. After the top drive was lifted onto the storage track, the guide track could be moved back into alignment with the drilling track and used to guide the traveling block dolly and other track guided equipment. This system had several shortcomings, for example, it required the use of a support line to assist in supporting the top drive on the storage tracks; required the connection of a raising sling between the traveling block and top drive to lift the top drive onto the storage track, followed by the disconnection of the raising sling from the traveling block; and the laterally extending track was immovable and obstructed the clear space or envelope needed on the right side of well center.

U.S. Pat. No. 3,835,940 (Winter, Jr.) discloses a drilling head connected to a carriage by a pivot pin so that the drilling head may be swung about a vertical axis to a position laterally of the drilling axis. A reversible hydraulic ram serves to move the drilling head between lateral positions. Movable latches, operated by a ram, are provided to lock the drilling head to the carriage during the drilling operation and for releasing same for movement of the drilling head away from the drilling position. A shortcoming of the Winter apparatus is that the distance the drilling head may be offset is limited to the length of its radius from the pivot point and in many cases this may be insufficient because it does not move the drilling head out of the clear space or envelope needed for the traveling block and other equipment which it may be desirable to use while the drilling head is removed from the drilling track.

U.S. Pat. Nos. 4,421,179 and 4,437,524 (Boyadjieff) disclose track sections and their connected parts, including the carriages and drilling unit, which are swung about a vertical axis to a position offset from the drilling axis. In the Boyadjieff apparatus, the distance the drilling unit may be offset is limited to the distance between the drilling unit and its pivot point. This may be insufficient for the same reasons as given for the apparatus of U.S. Pat. No. 3,835,940.

U.S. Pat. No. 5,038,87 (Dinsdale) discloses apparatus for laterally moving a direct drive drilling unit from the drilling or working rails to an offset position relative to the axis of a well. In a first embodiment, a pivotable frame carries a first pair of rails, which are aligned with fixed upper rails during drilling, and a second pair of rails used to support the drilling unit when it is to be offset. When the drilling unit or power swivel is to be removed from the upper rails and drilling system, the second pair of rails, or skids, are rotated into alignment with the upper rails and the power swivel is lowered by drawworks until the lowermost roller contacts stops on the skids. The frame is then rotated counterclockwise on a curved track until the first pair of lower rails is aligned with upper rails. Lock pins are used to engage the first pair of lower rails to the upper rails. Lock pins are also used to engage the frame to the structural braces to prevent rotation of the frame. In a second embodiment, the first pair of lower rails and second pair of lower rails are connected to a frame having an upper horizontal beam and a lower horizontal beam. When it is desired to position the power swivel in an offset or inactive position, lock pins are removed from rail splices and lock pins are removed from holes and flanges of the lower track and from the holes and flanges welded to the back side of rails. The frame is then slid from right to left relative to the well axis until it contacts a blocking top surface. This coincides with the second pair of lower rails, or skids, being aligned with the upper rails. The power swivel is then lowered until it is supported by stops. After disconnecting the power swivel from the traveling block, frame may be slid from left to right and returned to the position in which the first pair of lower rails is aligned with the upper rails. In the first embodiment of Dinsdale, the pivotable structure behind the rails obstructs the are behind the track and moves through the area behind the track which both obstructs the vision of the workers and prevents the use of the area behind the track for service lines, such as the fastline of the drawworks. Also, the distance the power swivel may be offset is limited to the radial distance from its pivot point, which may be insufficient to clear the unobstructed space or envelope needed around well center. In the second embodiment of Dinsdale, the frame used for lateral motion of the top drive extends immovably to the right of the drilling tracks and obstructs the space needed to the right of well center for such equipment as the service lines, the casing stabbing board, and the air hoist.

Despite the prior attempts to provide an apparatus for removing a top drive from the drilling track and hoisting system, a need exists for an apparatus for moving track guided equipment to and from a track, such as the drilling track of a subterranean drilling rig, which will both remove the top drive from the drilling track and which will locate the removed top drive at a position which does not obstruct the space needed around well center and on the derrick floor for activities which take place while the top drive is removed. The patents referenced in this application illustrate the long-felt need for an apparatus having these properties. There is also a commercial need for such an apparatus which is relatively inexpensive and easy to use.

SUMMARY OF THE INVENTION

The present invention is contemplated to overcome the above-described problems and meet the above-described needs. For accomplishing this, the present invention provides a novel and improved apparatus and method for moving track guided equipment to and from a track, such as a drilling track extending along the length of the derrick of a subterranean drilling rig.

The apparatus includes a movable working track, a secondary track, and power means. The movable working track is connectable to the derrick and is transversely movable between a first position in which the working track is aligned with the drilling track and a second position in which the working track is transversely displaced from alignment with the drilling track.

The secondary track is pivotably connected to the working track and is pivotable between a skewed position in which the secondary track is not transversely coplanar with the drilling track and the working track, and an in-line position in which the secondary track is about transversely coplanar with the drilling track and the working track. The secondary track is transversely movable with the working track so that the secondary track is aligned with the drilling track when the working track is in the second position.

The power means is used for pivoting the secondary track from the skewed position to the in-line position and transversely moving the secondary track in the in-line position and the working track to the second position of the working track. The power means also transversely moves the working track in the second position and the secondary track in the in-line position to the first position of the working track and pivots the secondary track from the in-line position to the skewed position in order to return the apparatus to its original position In a preferred embodiment, the power means includes an actuator having an extendable and retractable ram connected between the working track and the secondary track. The ram is extended to pivot the secondary track from the skewed position to the in-line position and transversely move the secondary track in the in-line position and the working track to the second position of the working track. The ram is retracted to transversely move the working track in the second position and the secondary track in the in-line position to the first position of the working track and to then pivot the secondary track from the in-line position to the skewed position.

The present invention also provides a method of moving track guided equipment to and from a track, such as a drilling track extending along the length of the derrick of a subterranean drilling rig. The equipment is movable about axially along the length of the drilling track between the upper end and the lower end of the drilling track. The method provides for connecting a working track to the derrick so that the working track is transversely movable between a first position in which the working track is aligned with the drilling track and a second position in which the working track is transversely displaced from alignment with the drilling track; connecting a secondary track to the working track so that the secondary track is pivotable between a skewed position, in which the secondary track is not transversely coplanar with the drilling track and the working track, and an in-line position in which the secondary track is about transversely coplanar with the drilling track and the working track, and so that the secondary track is transversely movable with the working track and is aligned with the drilling track when the working track is in the second position; pivoting the secondary track from the skewed position to the in-line position and transversely moving the secondary track in the in-line position and the working track to the second position of the working track so that the equipment may be lowered from the drilling track onto the secondary track; and transversely moving the working track in the second position and the secondary track in the in-line position to the first position of the working track and pivoting the secondary track from the in-line position to the skewed position in order to remove the equipment from the drilling track and align the working track with the drilling track.

The method also provides for connecting an actuator having an extendable and retractable ram between the working track and the secondary track; extending the ram to pivot the secondary track from the skewed position to the in-line position and transversely move the secondary track in the in-line position and the working track to the second position of the working track; and retracting the ram to transversely move the working track in the second position and the secondary track in the in-line position to the first position of the working track and to pivot the secondary track from the in-line position to the skewed position The method provides for stopping pivotal motion of the secondary track at the in-line position when the secondary track is being pivoted from the skewed position to the in-line position; preventing pivotal motion of the secondary track when the secondary track is in the in-line position; and preventing transverse motion of the working track when the secondary track is not in the in-line position.

The method also provides for connecting a first housing of an articulated guideway to the derrick; pivotably connecting a second housing of the articulated guideway to the first housing of the articulated guideway; movably disposing the working track in the first housing; and movably disposing the secondary track in the second housing in the first position of the working track. The method further provides for locating the working track and secondary track at the lower end of the drilling track.

It is an advantage of the present invention to provide an apparatus and method for moving track guided equipment to and from a track which will both remove a top drive from a drilling track and which will locate the removed top drive at a position which does not obstruct the space needed around well center for activities which take place while the top drive is removed.

It is an advantage of the present invention to provide such an apparatus and method in which the distance which the top drive may be displaced from the drilling track and well center may be varied as necessary to clear the area around well center.

It is an advantage of the present invention to provide such an apparatus which requires only one piston cylinder actuator to both transversely and pivotably move the track guided equipment to and from the drilling track.

BRIEF DESCRIPTION OF THE DRAWINGS

The present invention will be better understood by reference to the examples of the following drawings.

DETAILED DESCRIPTION OF THE PREFERRED EMBODIMENTS

Figure 1:
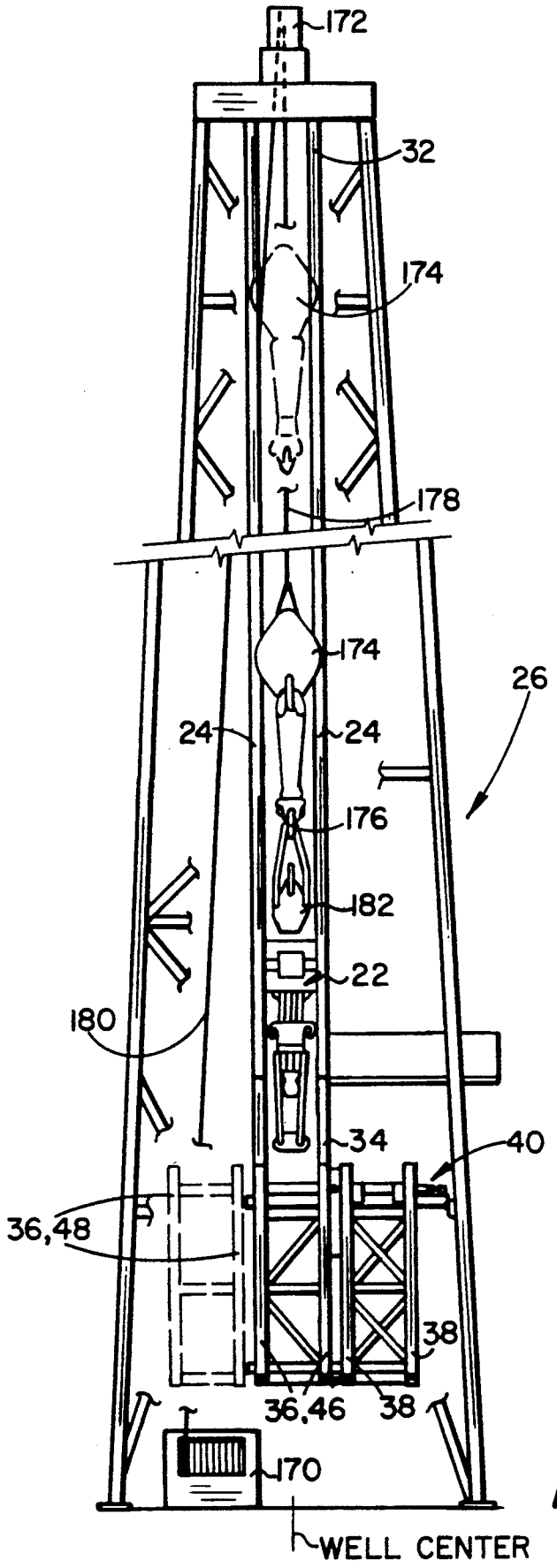
FIG. 1 is a front elevation view of a drilling rig showing the hoisting system, top drive, drilling track, and an embodiment of the apparatus of the present invention.

The preferred embodiments of the invention will now be described with reference to the drawings, wherein like reference characters refer to like or corresponding parts throughout the drawings.

FIGS. 1-10 present preferred embodiments of apparatus and method (hereinafter collectively referred to as "apparatus"), generally designated 20, for moving track guided equipment 22 to and from a track, such as a drilling track 24 extending along the length of the derrick 26 of a subterranean drilling rig. The apparatus 20 may be used with any track guided equipment and the tracks may be in virtually any orientation. For example, the apparatus 20 may be used to remove a drill string compensator (not illustrated), which is used to keep constant pressure on the drill bit as a semi-submersible offshore platform rises and falls with the surface of the water, from the tracks on the drilling derrick. In the preferred embodiment, as described herein, the apparatus is used with the top drive, also designated 22, of a top drive drilling system, as would be known to one skilled in the art in view of the disclosure contained herein. The top drive 22 is movable about axially along the length of the drilling track 24 between the upper end 32 and the lower end 34 of the drilling track 24.

For purposes of defining the relationships between the components described herein, vertical or axial is defined as a direction about parallel to, or coaxial with, the extension of the drilling track 24 along the derrick 26; transverse is defined as being a direction about perpendicular to the vertical direction and about coplanar with the two rails 24 of the drilling track 24; and normal is defined as being a direction about perpendicular to both the vertical direction and the transverse direction.

Figure 4:
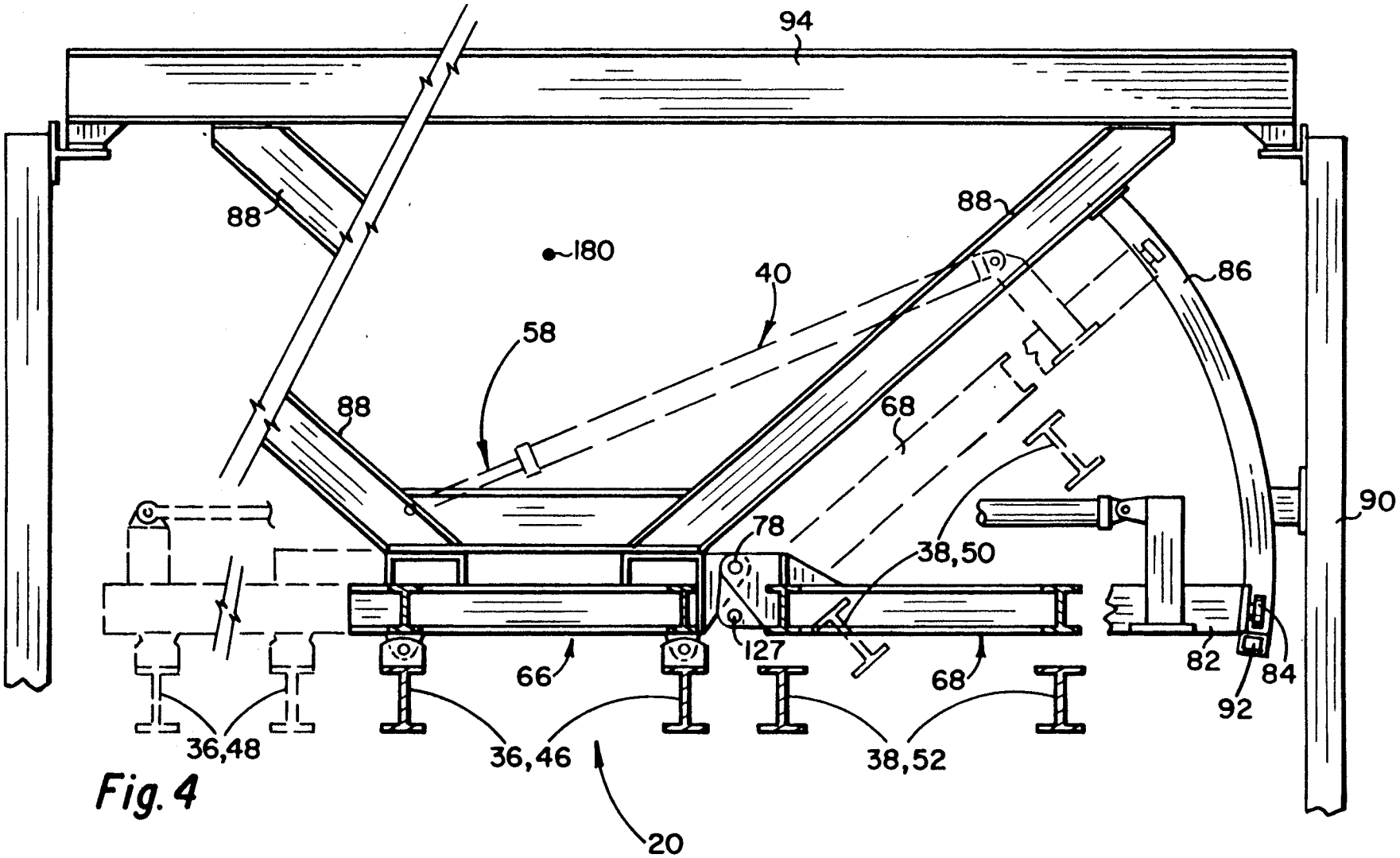
FIG. 4 is a top view along line 4—4 of FIG. 5 which includes the working track and storage track and illustrates the position of the apparatus in phantom.

Referring to the example of FIGS. 1 and 4, the apparatus 20 may be generally described as including a movable working track 36, a secondary track 38, and power means 40. The working track 36 is connectable to the derrick 26 and is transversely movable between a first position 46 (best seen in FIG. 1) in which the working track 36 is aligned with the drilling track 24 and a second position 48 in which the working track 36 is transversely displaced from alignment with the drilling track 24.

The secondary track 38 is pivotably connected to the working track 36 and is pivotable between a skewed position 50 (best seen in FIGS. 2 and 4) in which the secondary track 38 is not transversely coplanar with the drilling track 24 and the working track 36 and an in-line position 52 (best seen in FIGS. 3 and 4) in which the secondary track 38 is about transversely coplanar with the drilling track 24 and the working track 36. The secondary track 38 is also transversely movable with the working track so that the secondary track 38 is aligned with the drilling track 24 when the working track 36 is in the second position 48.

The power means 40 is used for pivoting the secondary track 38 from the skewed position 50 to the in-line position 52 and for transversely moving the secondary track 38 in the in-line position 52 and the working track 36 to the second position 48 of the working track 36. The power means 40 is also used for transversely moving the working track 36 in the second position 48 and the secondary track 38 in the in-line position 52 to the first position 46 of the working track 36 and pivoting the secondary track 38 from the in-line position 52 to the skewed position 50.

The power means 40 may be any type of actuator capable of executing the functions described herein. For example, the power means 40 may be provided by motor driven gears, such as a rack and pinion type device. Preferably, the power means 40 is an actuator, also designated 40, having an extendable and retractable ram 58 connected between the working track 36 and the secondary track 38. The preferred actuator is a hydraulically operated piston-cylinder actuator, although other types of actuators such as pneumatically or electrically operated actuators may be used, as would be known to one skilled in the art in view of the disclosure contained herein. Referring to the example of FIGS. 2–4, in the preferred embodiment, the power means pivots the secondary track 38 from the skewed position 50 to the in-line position 5 and transversely move the secondary track 38 in the in-line position 52 and the working track 36 to the second position 48 of the working track 36 by extending the ram 58. The power means 40 transversely moves the working track 36 in the second position 48 and the secondary track 38 in the in-line position 52 to the first position 46 of the working track 36 and pivots the secondary track 38 from the in-line position 52 to the skewed position 50 by retracting the ram 58.

Figure 3:
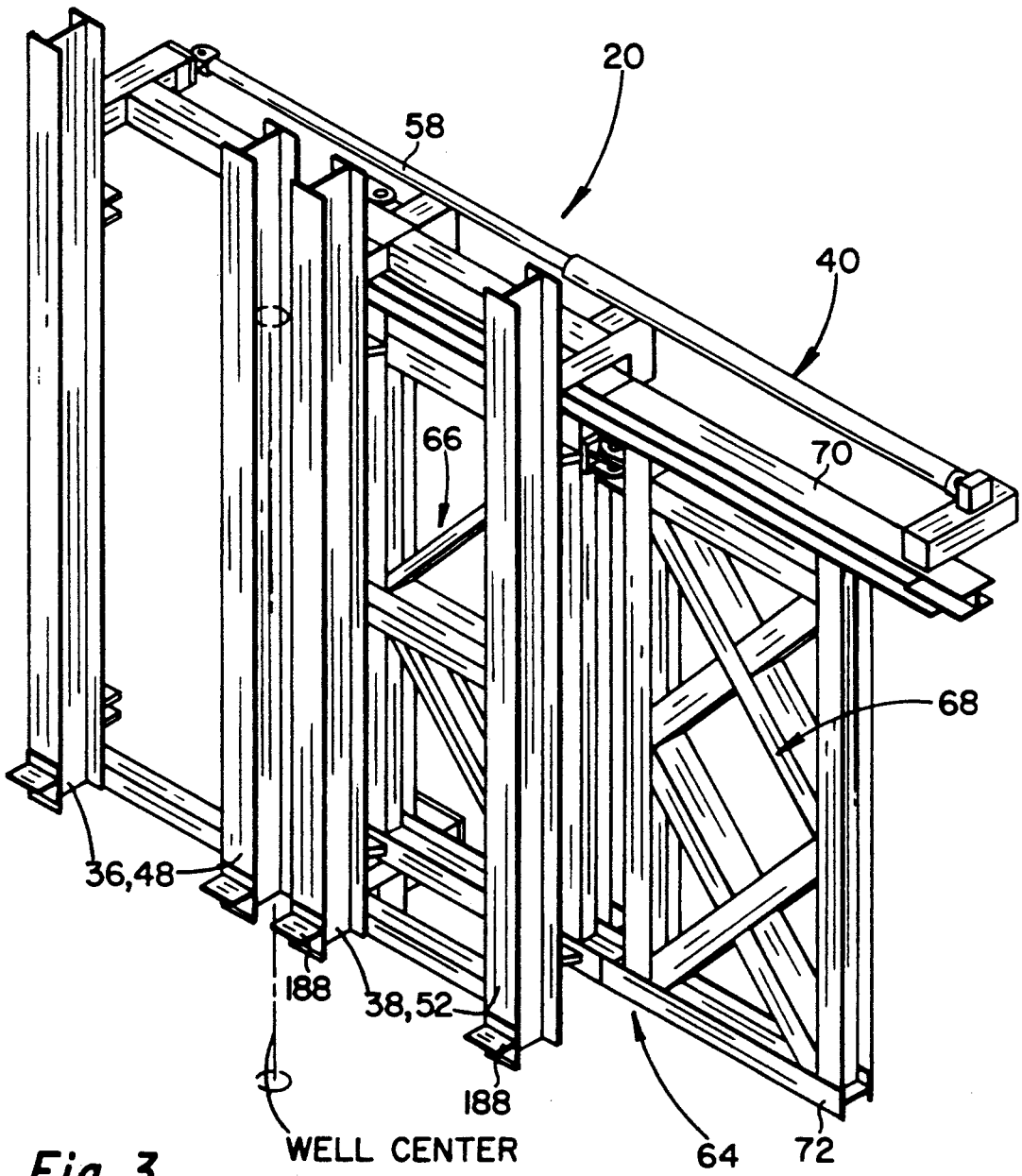
FIG. 3 is a perspective view of the apparatus of FIG. illustrating the working track in the second position and the secondary track in the in-line position.
Figure 5:
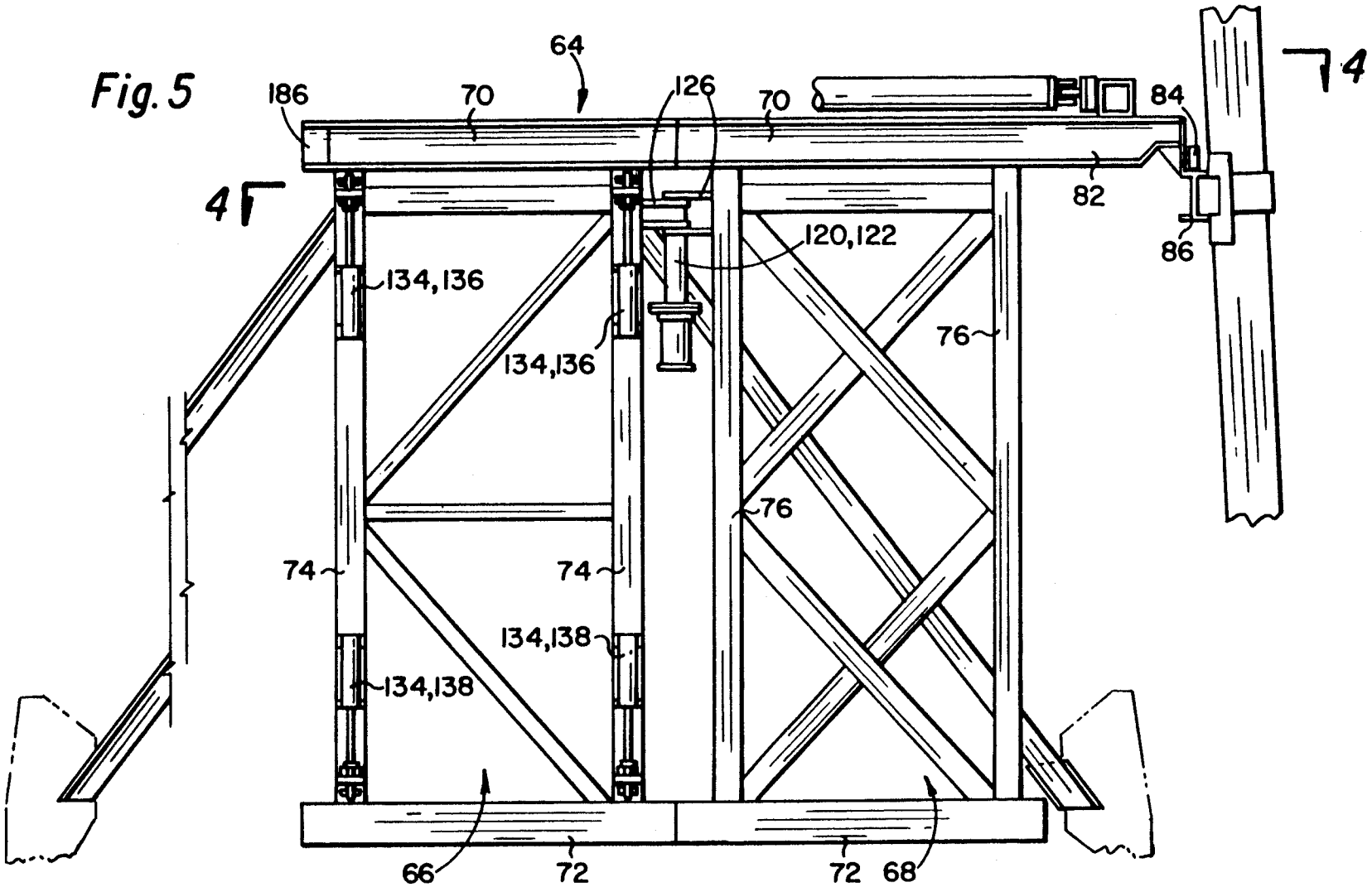
FIG. 5 is a front elevation view of the first and second housings of the guideway in the in-line position.

In the preferred embodiment, referring to the example of FIGS. 3–5, the apparatus 20 includes an articulated guideway, generally designated 64. The guideway 64 may be a track, rail, roller(s), bearing(s), or equivalent which will support the tracks 36, 38 and allow the transverse motion of the tracks 36, 38. In the prototype apparatus 20, the guideway 64 includes a first housing 66 connected to the derrick 26 and a second housing 68 pivotably connected to the first housing 66. The working track 36 is movably disposed in the first housing 66 and the secondary track 38 is movably disposed in the second housing 68 in the first position 46 of the working track 36. The second housing 68 and secondary track 38 pivot together as the secondary track is pivoted between the skewed position 50 and the in-line position 52.

Referring to the example of FIG. 5, the preferred guideway 64 includes an upper roller track 70 and a lower roller track 72. The upper and lower roller tracks 70, 72 extend about horizontally across the first housing 66 and second housing 68 of the articulated guideway 64. The roller tracks 70, 72 are jointed between the first and second housing to allow articulation or pivoting of the guideway 64. The upper roller track 70 and the lower roller track 72 of the first housing 66 are connected together with two vertical beams 74. The upper roller track 70 and the lower roller track 72 of the second housing 68 are connected together with two vertical beams 76. An upper hinge 78 (FIG. 4) and a lower hinge 80 (FIG. 2) connect the first housing 66 to the second housing 68. The hinges 78, 80 allow pivotal motion about a vertical axis generally parallel to the vertical beams 74, 76 and the drilling track 24.

The free end 82 of the second housing 68 includes a vertical bearing means 84 for transferring vertical loadings, such as the weight of the secondary track 38 and top drive 22 (when the top drive is supported on the secondary track 38) to the derrick 26. The vertical bearing means 84 may be a roller, sliding surface, bearing, or equivalent which will transfer the vertical loading of the secondary track 38 to the derrick structure and allow pivotal motion of the secondary track 38 and second housing 68. In the preferred embodiment, the vertical bearing means 84 is a roller, also designated 84, having a rotational axis which remains perpendicular to the pivotal axis of the second housing 68 as the second housing pivots between the skewed position 50 and the in-line position 52 with the secondary track 38. The roller 84 engages an arcuate roller track 86 which is connected to the derrick 26. In the prototype apparatus 20, the roller track 86 is connected between one of the support members 88 which connect the apparatus 20 to the derrick 26 and the side 90 of the derrick, as best seen in FIG. 4. The arcuate roller track 86 includes stop means 92 which stops the pivoting of the secondary track 38 and second housing 68 at the in-line position 52 when they are pivoting from the skewed position 50 to the in-line position 52. In the prototype apparatus 20, the stop means 92 is a mechanical stop or block fixed on the roller track 86 to obstruct the pivotal motion of the free end 82 of the second housing 68 and the roller 84

The first housing 6 of the articulated guideway 64 is connected to the derrick 26. The first housing 66 should be connected to the derrick at such a location that the working track 36 and secondary track 38 will be properly aligned with the drilling track 24. Normally, the drilling track 24 is spaced away from the girders 94 of the derrick 26 in order to align the top drive 22 with the hoisting equipment and the pipe handling equipment of the drilling rig and with well center. As is the drilling track 24, the first housing 66 will normally be connected to the derrick girders 94 with support members 88, as would be known to one skilled in the art in view of the disclosure contained herein. The first housing 66 should be securely connected to the derrick 26 and support members 88 so as to support all the loadings placed on the apparatus 20 by the track guided equipment 22 and drilling operations.

Figure 7:
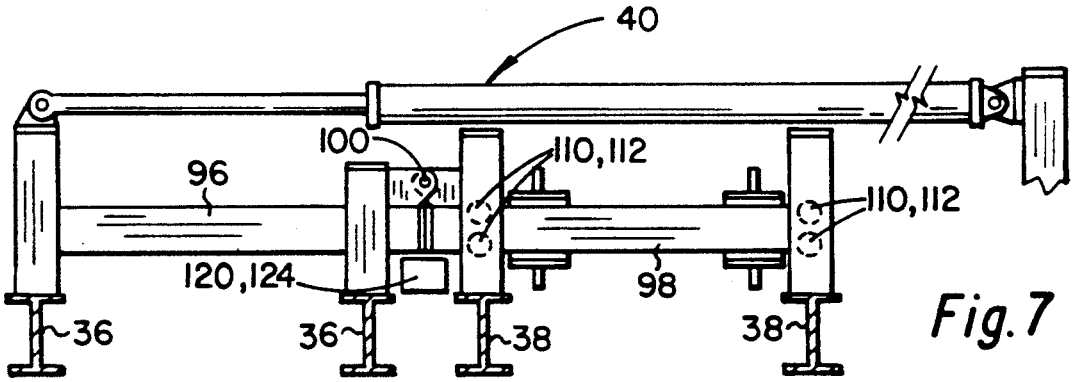
FIG. 7 is a top view along line 7—7 of FIG. 6.
Figure 6:
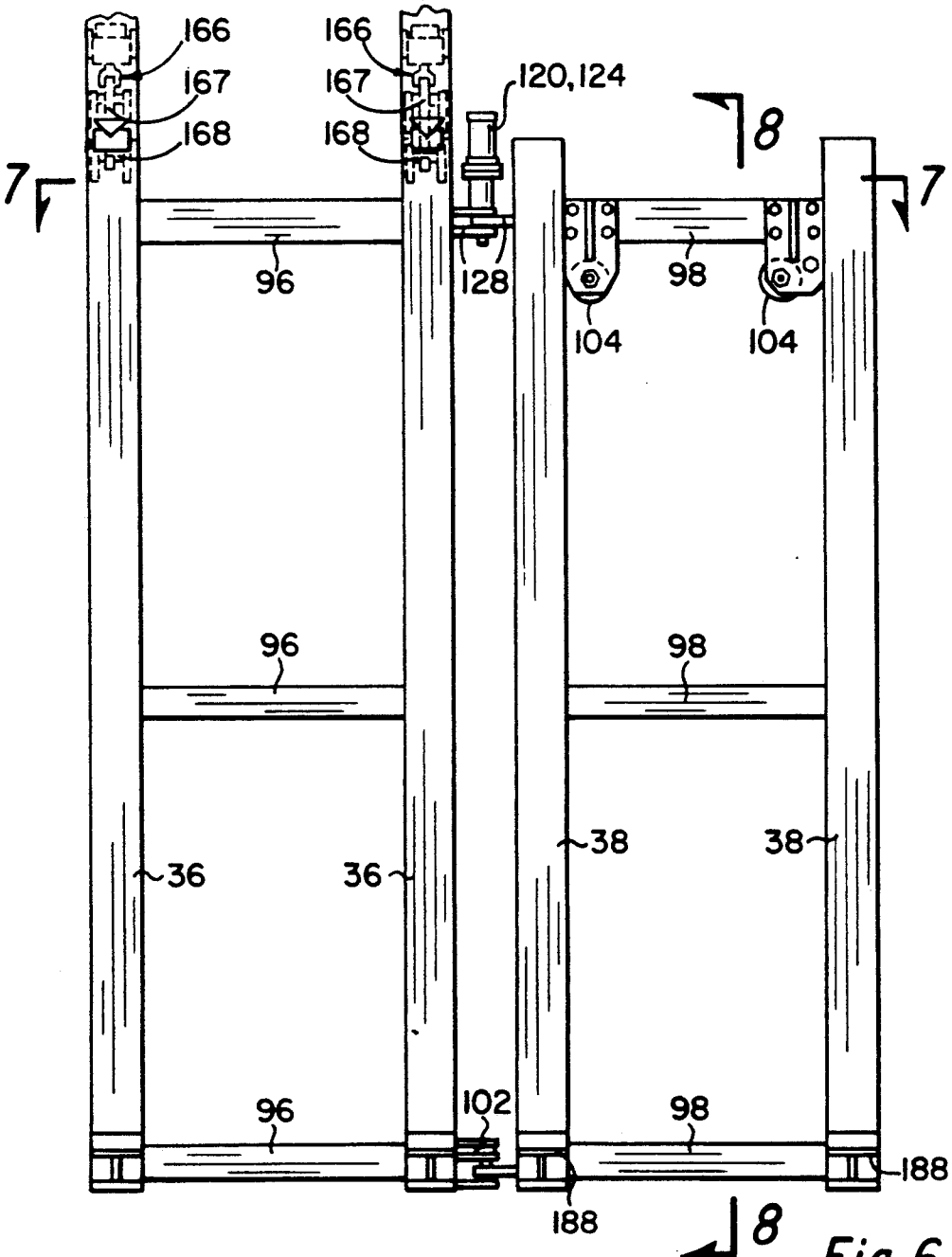
FIG. 6 is a front elevation view of the working and storage tracks, in the in-line position.

Referring to the example of FIGS. 6 and 7, preferably the working track 36 includes two rails, also designated 36, held in a generally parallel spaced apart relationship by crossbraces 96. The preferred second track 38 includes two rails, also designated 38, held in a generally parallel spaced apart relationship by crossbraces 98. The working track 36 and the secondary track 38 are connected together using upper hinge 100 and lower hinge 102. The hinges 100, 102 allow the working track 36 and secondary track 38 to pivot relative to one another about a vertical axis generally parallel to the length of the tracks 36, 38.

The working track 36 and secondary track 38 also include vertical load bearing means 104 for transferring the vertical loading placed on the working track 36 and secondary track 38 by the track guided equipment 22, drilling operations, and other sources to the guideway 64 and derrick 26; and for allowing the working track 36 and secondary track 28 to move transversely with respect to the drilling track 24 on the guideway 64. The vertical load bearing means 104 may be any type of roller, sliding surface, bearing, or equivalent which will transfer the vertical loading and allow the desired motion on the guideway 64. In the preferred embodiment, referring to the example of FIG. 6, the vertical load bearing means 104 includes two rollers, also designated 104, having rotational axes perpendicular to the longitudinal axis of the drilling track and perpendicular to the direction of travel of the working track 36 and secondary track 38. Preferably, the rollers 104 are located on the secondary track 38 near the upper end of the track 38 with one roller 104 being located adjacent each rail of the secondary track 38. More preferably, the rollers 104 are connected to the uppermost crossbrace 98 of the secondary section. Preferably, the upper roller track 70 of the guideway 64 is an I-beam, best seen in FIG. 8, and the rollers 104 rollingly engage the inside of the horizontal lower flange of the upper roller track 70.

Figure 8:
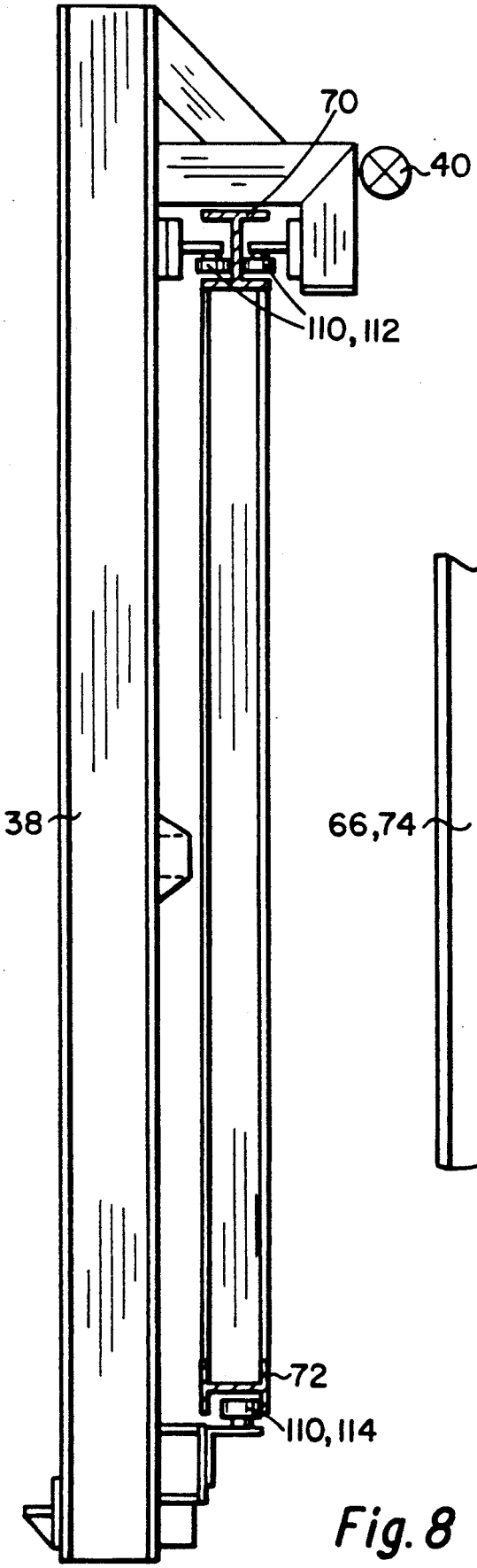
FIG. 8 is a section view along line 8—8 of FIG. 6.

Referring to the example of FIGS. 7 and 8, the working track 36 and secondary track 38 also include horizontal load bearing means 110 for transferring horizontal loadings placed on the working track 36 and secondary track 38 by the track guided equipment 22, drilling operations, and other sources to the guideway 64 and derrick 26 and for facilitating transverse movement of the working track 36 and the secondary track 38 on the guideway 64. The horizontal load bearing means 110 may be any type of roller, sliding surface, bearing, or equivalent which will transfer the horizontal loading and allow the desired transverse motion on the guideway 64. In the prototype apparatus 20, the horizontal load bearing means 110 includes four rollers 112 having rotational axes about parallel to the axis of the drilling track 24 and located near the upper end of the secondary track 38. Two rollers 112 are located on the back side of each rail of the secondary track 38 so as to rollingly engage the web of the I-beam of the upper roller track 70. The rollers 112 are positioned to engage opposite sides of the vertical surface of the web of the I-beam 70 in order to transfer horizontal loadings directed in either direction normal to the vertical axis of the drilling track 24. The horizontal load bearing means 110 also includes a lower roller 114 near the lower end of the secondary track 38. The lower roller 114 rollingly engages the vertical surface which is the flange of the channel which creates the lower roller track 72. The lower roller 114 is primarily intended to transfer horizontal loadings which are directed toward the derrick 26 to the lower roller track 72 and derrick 26, although the opposed vertical flanges which create the channel of the lower roller track 72 will carry horizontal loadings in either direction normal to the derrick 26.

In the prototype apparatus 20, the bearing means or rollers 104, 110, 112 are positioned on the secondary track 38 and second housing 68 to carry the working track 36, i.e., in the prototype apparatus 20 there are no bearing means or rollers located on the working track 36. The bearing means or rollers 104, 110, 112, 114 should have sufficient load bearing strength that the working track 36 may be cantilevered from the guideway 64 in the second position 48 of the working track 36, as exemplified in FIGS. 1, 3, and 4.

As previously mentioned, the preferred power means 40 is a hydraulically-actuated piston-cylinder having an extendable ram 58. Referring to example FIGS. 3 and 4, in the prototype apparatus 20, one end of the ram 58 is connected to the working track 36 and the other end is connected to the second housing 68 of the articulated guideway 64 so that the ram 58 will pivot the second housing 68 and secondary track 38 from the skewed position toward the in-line position 52 as the ram 58 is extended. As also previously mentioned, stop means 92 is provided for stopping the pivotal motion of the secondary track 38 at the in-line position 52 when the secondary track 38 is being pivoted from the skewed position to the in-line position 52. Referring to example FIGS. 5 and 6, anti-pivot means 120 are also provided for preventing pivotal motion of the secondary track 38 when the secondary track 38 is in the in-line position 52. The anti-pivot means 120 may be any type of mechanical stop, fastener, detent, or equivalent. In the preferred embodiment, the anti-pivot means 120 includes an anti-pivot pin 122 in the guideway 64 and an anti-pivot pin 124 which fastens the working track 36 to the secondary track 38. Referring to example FIG. 5, in the prototype apparatus 20, the anti-pivot pin 122 of the guideway 64 is placed in the upper hinge plates 126 of the guideway 64. The anti-pivot pin 122 is connected to one of the plates 126 of the hinge so as to align with a receptacle, such as a hole 127 (best seen in FIG. 4), in the other plate when the secondary track 38 is in the in-line position 52 and the plates 126 are overlapped. The anti-pivot pin 122 should be placed in such a manner as to maximize the ability of the pin 122 to secure the secondary track 38 in the in-line position 52, as would be known to one skilled in the art in view of the disclosure contained herein.

Referring to example FIG. 6, in the prototype apparatus 20, the anti-pivot pin 124 is located on one of the upper hinge plates 128 between the working track 36 and the secondary track 38. The anti-pivot pin 124 is located on one of the plates 128 in such a manner as to align with a receptacle, such as a hole 129 (best seen in FIG. 2), in the other of the plates 128 when the secondary track 38 is in the in-line position and the plates 128 are overlapped. The anti-pivot pin 124 should be located in such a manner as to maximize its ability to secure the secondary track 38 in the in-line position 52, as would be known to one skilled in the art in view of the disclosure contained herein. The anti-pivot pins 122, 124 may be manually operated or may be electrically, pneumatically, hydraulically, or equivalently powered pins. In the prototype apparatus 20, the anti-pivot pins 122, 124 are hydraulically actuated piston-cylinder devices which are actuated by switches located near the derrick floor.

Figure 9:
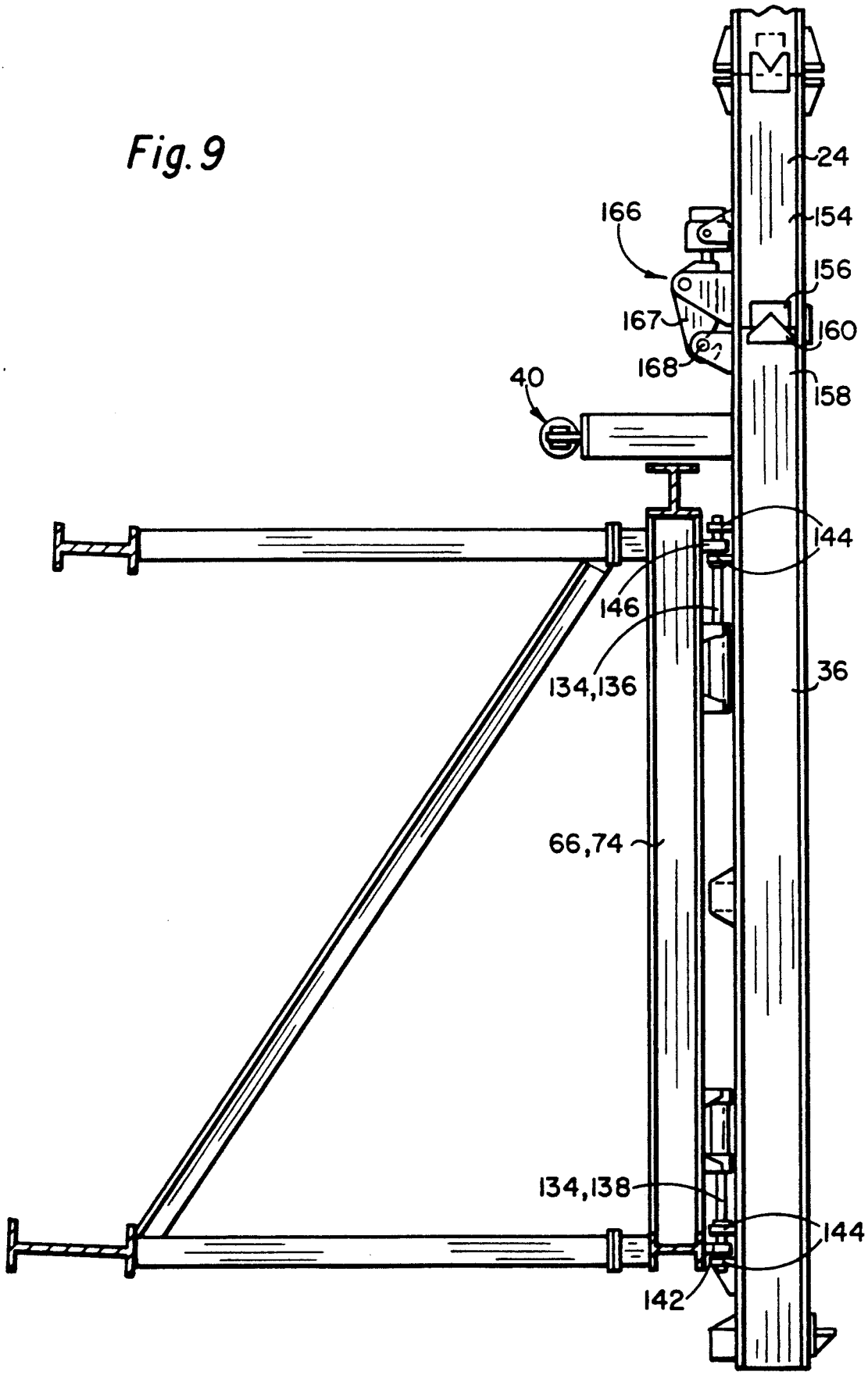
FIG. 9 is a left side elevation view of the apparatus shown in FIG. 1.

Referring to example FIGS. 5 and 9, latch means 134 are provided for preventing transverse motion of the working track 36 when the secondary track 38 is not in the in-line position 52. The latch means 134 may be any type of mechanical stop, fastener, detent, or equivalent. In the prototype apparatus 20, the latch means 134 includes two upper latch pins 136 and two lower latch pins 138. One upper latch pin 136 is located at the upper end of each vertical beam 74 of the guideway first housing 66 and one lower latch pin 138 is located at the lower end of each of the vertical beams 74 of the guideway first housing 66. The lower latch pins 138 align with receptacles, such as holes, in tabs 140 connected to the back side of the rails of the working track 36 and with a hole in the lower stabilizing tab 142 at the lower end of the vertical beam 74 when the working track 36 is in the first position 46. The upper latch pins 136 similarly align with holes in upper tabs 144 on the back side of the rails of the working track 36 and with a hole in the upper stabilizing tab 146 when the working track 36 is in the first position 46. Therefore, when the working track 36 is in the first position 46, the upper and lower latch pins 136, 138 may be extended to engage the holes in tabs 140, 142, 144, 146, thereby latching the working track 36 to the first housing 66 and preventing transverse motion of the working track 36 relative to the first housing 66. The upper and lower latch pins 136, 138 may be manually operated pins or may be power actuated pins, such as electrically, hydraulically, or pneumatically powered pins. In the preferred embodiment, the latch pins 136, 138 are hydraulically actuated piston-cylinder pins which are actuated by switches (not illustrated) near the floor of the derrick 26.

Referring to the example of FIG. 9, in the preferred embodiment, the upper latch pins 136 also lift the working track 36 into aligning engagement with the drilling track 24. The lower ends 154 of the rails 24 of the drilling track are provided with guides 156 which receive the upper ends 158 of the rails of the working track 36 and guide the working track 36 into proper alignment with the drilling track 24. The upper ends 158 of the working track 36 are shaped to cooperate with the guides 156. In the preferred embodiment, the upper ends 158 of the working track 36 have protrusions 160 which engage the guides 156 and are guided into proper alignment by the shape of the guides 156. In the prototype apparatus 20, the protrusions 160 are V-blocks attached to the upper ends 158 of the rails 36 of the working track and the guides 156 are V-block guides, as would be well known to one skilled in the art in view of the disclosure contained herein.

Figure 10:
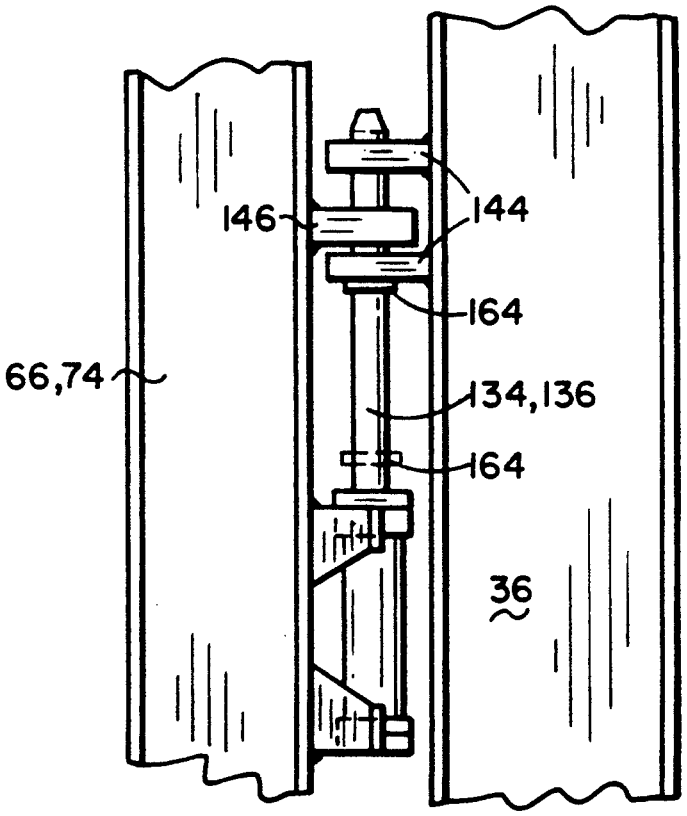
FIG. 10 is an enlarged view of an upper latch pin of FIG. 9.

The preferred upper latch pins 136 include a lifting ring 164, best seen in FIG. 10, which engages the upper tabs 144 as the pin is extended in order to lift the working track 36 into aligning engagement with the drilling track 24. Referring to FIG. 9, a locking latch 166 is provided at the lower end 154 of each rail 24 of the drilling track to latch the working track 36 to the drilling track 24 once the working track 36 is lifted into alignment with the drilling track 24. The locking latches 166 may be mechanical fasteners, detents, or equivalent fastening devices. In the prototype apparatus, the locking latch 166 is a spring-loaded, air-released rotochamber 166 connected to a hook 167 which captures a pin 168 on the working track 36. External power (air pressure) is required to disengage the hook 167 from the pin 168 to ensure the working track 36 will remain secured in its normal working position, i.e., in the absence of a pneumatic signal of sufficient strength to operate the rotochambers 166 and open the hooks 167 the spring-loading of the rotochambers keeps the hooks closed. The guides 156 and locking latch 166 are used in the first position 46 of the working track 36 because it is the working position, i.e., it is the position in which the apparatus 20 will be placed during drilling operations. During drilling operations the top drive 22 and other track guided equipment will be frequently moved between the working track 36 and the drilling track 24 and will often exert great loadings on the working track 36 and drilling track 24. It is important that the working track 36 remain sufficiently aligned with the drilling track 24 that no problems, such as binding of the equipment guided by the tracks 24, 36 or disengagement of the track guided equipment from the tracks 24, 36, is encountered during drilling operations.

The operation of the invention 20 will now be described. Referring to FIG. 1, the top drive 22 is normally moved up and down the drilling track 24 by the hoisting system. The hoisting system includes the drawworks 170, crown block 172, traveling block 174, hook 176, and the wire cable 178 which runs between these components. The fastline 180 portion of the cable 178 normally runs in the area between the derrick girders 94 and the support members 88 (as best exemplified in FIG. 4). The traveling block 174 and hook 176 are connected to the top drive 22 through a swivel 182 which allows the drill string 18 to rotate and which provides a rotating, pressure-tight seal and passageway for drilling mud to be pumped down the inside of the drill string. The hook 176 may be eliminated and the swivel 182 connected directly to the traveling block 174 if it is desired to reduce the size of the assembly.

Figure 2:
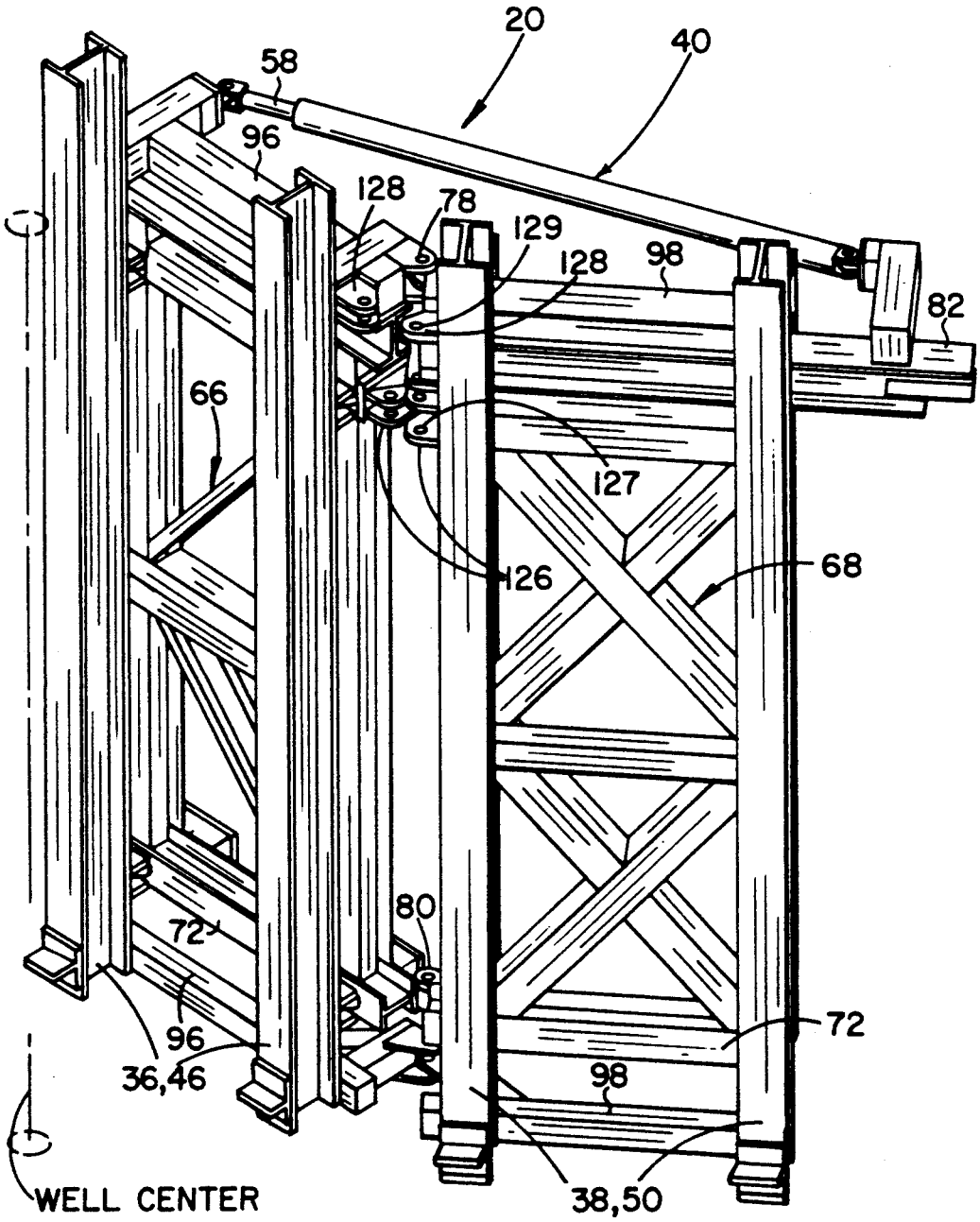
FIG. 2 is a perspective view of the apparatus in FIG. 1 illustrating the working track in the first position and the secondary track in the skewed position.

In order to move the top drive 22 from the drilling track 24, the top drive 22 is lifted onto the drilling track 24 clear of the working track 36. In the prototype apparatus 20, assuming the top drive 22 has been in operation, the working track 36 will be latched into a lifted alignment with the drilling track 24 by the locking latches 166. In the prototype apparatus 20, the upper hinge 78 and lower hinge 80 allow the working track 36 and first housing 66 to move vertically with respect to the secondary track 38 and second housing 68 so that the working track 36 may be lifted into alignment with the drilling track 24 without having to lift the secondary track 38. Also, in prototype apparatus 20, the hinge plates 126, 128 have a close tolerance and are misaligned when the working track is in the lifted position. The hinge plates 126, 128 are properly aligned for hinging motion of the tracks 36, 38 when the working track 36 is in its unlifted position with respect to the secondary track 38. Therefore, the working track 36 should only be raised and lowered while the secondary track 38 is in the skewed position 50, i.e., when the hinge plates 126, 128 are not in overlapping engagement, as best illustrated in FIG. 2.

Consequently, after the top drive is lifted onto the drilling track 24, it should be verified that the secondary track 38 and second housing 68 are in the skewed position 50. The working track 36 is then lifted with the upper latch pins 136 to unload the hooks 167 of the locking latches 166; the hooks 167 are opened to release the working track 36 (in the prototype apparatus 20 this is accomplished by applying air pressure to the rotochambers 166 to open the hooks 167) and the working track 36 is lowered by fully retracting the upper latch pins 136. Referring to example FIG. 4, the power means 40 is then extended to pivot the secondary track 38 and second housing 68 from the skewed position 50 to the in-line position 52. As the second housing 68 pivots, it will encounter stop 92 when it reaches the in-line position 52. In the prototype apparatus 20, the adjacent ends of the cross-braces 96, 98 (FIG. 2); upper roller track sections 70 (FIG. 5) and lower roller track sections 72 (FIG. 5) are also designed to contact and prevent further pivoting when the second housing 68 reaches the in-line position 52. When the apparatus 20 reaches the in-line position 52, the anti-pivot pins 122, 124 (FIGS. 5 and 6) are actuated/extended to latch the working track 36 to the secondary track 38 in the in-line position 52. The power means 40 should then be adjusted to remove all loading (created by the extension or retraction of the power means) from the power means 40 and from the lower latch pins 138. The lower latch pins 138 are then retracted to allow transverse motion of the working track 36 and secondary track 8. The upper and lower latch pins 136, 138 are best seen in FIG. 9. The anti-pivot pins 122, 124; latch pins 136, 138; and locking latch 166 may be operated using independent switches (as previously mentioned) or their operation may be programmed into an automated system, as would be known to one skilled in the art in view of the disclosure contained herein.

Once the working track 36 is free for transverse motion and the secondary track 38 is locked in the in-line position, the ram 58 of power means 40 is further extended to move the working track 36 of track to its second position 48, as exemplified in FIGS. 3 and 4. A transverse stop 186 (FIG. 5) is provided which stops the transverse motion of the working track 36 and secondary track 38 when the secondary track 38 is aligned with the drilling track 24. the upper roller track 70 to obstruct motion of the rollers 104 when the secondary track 38 is aligned with the drilling track 24. The top drive 22 is then lowered from the drilling track 24 onto the secondary track 38 until the top drive 22 rests on skids 188 fixed at the bottom of the rails of the secondary track 38; the hoist assembly is disconnected from the top drive 22; and the ram 58 of power means 40 is retracted to move the working track 36 to its first position 46. When the working track 36 is returned to its first position 46, the lower latch pins 138 are actuated or extended to engage with their corresponding receptacles and prevent transverse motion of the tracks 36, 38. The anti-pivot pins 122, 124 are then disengaged/retracted to allow pivotal motion of the secondary track 38 and second housing 68. Retraction of the power means 40 and ram 58 are then continued to move the secondary track 38 and top drive 22 to the skewed position 50. The retraction of the power means 40 should be stopped short of contact of the secondary track 38 and second housing 68 with the derrick. Once the secondary track 38 and second housing 68 have reached the skewed position, the upper latch pins 136 are actuated or extended to lift the working track 36 into aligning engagement with the drilling track 24. The locking latches 166 are then depressurized to close the hooks 167 and latch the working track 36 to the drilling track 24.

If it is desired to remove the top drive 22 from the secondary track 38, the top drive 22 may be lifted off the top of the secondary track 38 using a hoisting system; or the top drive 22 may be supported by a hoisting system, the skids 188 removed from the lower end of the secondary track 38, and the top drive 22 lowered off the lower end of the secondary track 38.

When it is desired to move the top drive 22 from the secondary track 38 to the drilling track 24, the previous sequence is essentially reversed. The secondary track 3 carrying the top drive 22 should be placed in the skewed position 50. The working track 36 is then lifted using the upper latch pins 136; the locking latches 66 are pressurized and disengaged from the working track 36; and the working track 36 is lowered by fully retracting the upper latch pins 136. The secondary track 38 and second housing 68 are then moved to the in-line position 52 by partially extending the power means 40. Once the in-line position 52 is reached, it should be verified that the ram 58 of power means 40 is not placing a horizontal or transverse load on the lower latch pins 138 and the lower latch pins should be retracted from their receptacles to allow transverse motion of the tracks 36, 38. The anti-pivot pins 122, 124 are then actuated/extended to lock the tracks 36, 38 in the in-line position; the power means 40 is extended until the secondary track 38 is aligned with the drilling track 24; the hook 176 is connected to the top drive 22; and the hoisting system is used to lift the top drive from the secondary track 38 to the drilling track 24. The power means 40 is then retracted to move the working track 36 into alignment with the drilling track 24; the lower latch pins 138 are extended to prevent transverse motion of the tracks 36, 38; the anti-pivot pins 122, 124 are retracted to allow pivotal motion of the secondary track 38 and second housing 68; the secondary track 38 and second housing 68 are moved into the skewed position 50; the working track 36 is lifted into alignment with the drilling track 24; and the locking latches 166 are depressurized to latch the working track 36 to the drilling track 24. Normal operation may then be resumed with the top drive 22 operating on the drilling track 24 and working track 36.

Although the apparatus 20 is described and illustrated herein as located at the lower end of the drilling track 24, it is intended to be understood that the apparatus 20 may be placed anywhere along the length of the drilling track 24. Also, the apparatus 20 is described and illustrated herein as being located on the inside of the derrick 26 adjacent the drawworks 170 with the secondary track 38 and second housing 68 being pivotably connected to the right-hand side of the working track 36 and first housing 66, as viewed from well center. It is intended to be understood that the apparatus 20 may be located on any side of the derrick 26 or other structure and the secondary track 38 and second housing 68 may be pivotably connected to either ide of the working track 36 and second housing 68 with the power means 40 and other structure of the apparatus 20 being appropriately rearranged, as would be known to one skilled in the art in view of the disclosure contained herein. The distance the secondary track 38 (and top drive 22 when placed on the secondary track 38) is displaced from well center in the skewed position 50 may be varied by varying the distance between the working track 36 and secondary track 38. Preferably, this is accomplished by increasing the distance between the hinge points of hinges 100, 102 (FIGS. 6 and 7) and the adjacent secondary track 38 and by increasing the distance between the hinge points of hinges 78, 80 and the second housing 68 so that the working track 36 and first housing 66 do not extend transversely any farther than necessary when the secondary track 38 is in the skewed position 50. This may be accomplished by physically increasing the length of the hinge plates 126, 128 between their hinge points and the secondary tracks and second housing.

While presently preferred embodiments of the invention have been described herein for the purpose of disclosure, numerous changes in the construction and arrangement of parts and the performance of steps will suggest themselves to those skilled in the art in view of the disclosure contained herein, which changes are encompassed within the spirit of this invention, as defined by the following claims.

What is claimed is:

1. Apparatus for moving track-guided equipment to and from a track, such as a drilling track extending along the length of the derrick of a subterranean drilling rig in which the equipment is movable about axially along the length of the drilling track between the upper end and lower end of the drilling track, the apparatus comprising:

a movable working track connectable to the derrick and transversely movable between a first position in which the working track is aligned with the drilling track and a second position in which the working track is transversely displaced from alignment with the drilling track;

a secondary track pivotably connected to the working track and being pivotable between a skewed position in which the secondary track is not transversely coplanar with the drilling track and the working track and an in-line position in which the secondary track is about transversely coplanar with the drilling track and the working track, the secondary track being transversely movable with the working track so that the secondary track is aligned with the drilling track when the working track is in the second position; and power means for pivoting the secondary track from the skewed position to the in-line position and transversely moving the secondary track in the in-line position and the working track to the second position of the working track; and for transversely moving the working track in the second position and the secondary track in the in-line position to the first position of the working track and pivoting the secondary track from the in-line position to the skewed position.

2. Apparatus of claim 1 in which the power means comprises:

an actuator having an extendable and retractable ram connected between the working track and the secondary track; and wherein the power means pivots the secondary track from the skewed position to the in-line position and transversely moves the secondary track in the in-line position and the working track to the second position of the working track by extending the ram; and wherein the power means transversely moves the working track in the second position and the secondary track in the in-line position to the first position of the working track and pivots the secondary track from the in-line position to the skewed position by retracting the ram.

3. Apparatus of claim 1, comprising:

stop means for stopping pivotal motion of the secondary track at the in-line position when the secondary track is being pivoted from the skewed position to the in-line position.

4. Apparatus of claim 1, comprising: anti-pivot means for preventing pivotal motion of the secondary track when the secondary track is in the in-line position.

5. Apparatus of claim 1, comprising:

latch means for preventing transverse motion of the working track when the secondary track is not in the in-line position.

6. Apparatus of claim 1, comprising:

an articulated guideway having a first housing connected to the derrick and a second housing pivotably connected to the first housing; and wherein the working track is movably disposed in the first housing and the secondary track is movably disposed in the second housing in the first position of the working track.

7. Apparatus of claim 1:

wherein the working track and secondary track are located at the lower end of the drilling track.

8. Apparatus for moving track guided equipment to and from a track, such as a drilling track extending along the length of the derrick of a subterranean drilling rig, in which the equipment is movable about axially along the length of the drilling track between the upper end and the lower end of the drilling track, the apparatus comprising:

an articulated guideway having a first housing connected to the derrick and a second housing pivotably connected to the first housing;

a movable working track movably disposed in the guideway and movable between a first position in which the working track is aligned with the drilling track and a second position in which the working track is transversely displaced from alignment with the drilling track, the working track being disposed in the first housing in the first position;

a secondary track pivotably connected to the working track and movably disposed in the articulated guideway, the secondary section being pivotably connected to the working track and being pivotable between a skewed position in which the secondary track is not transversely coplanar with the drilling track and the working track and an in-line position in which the secondary track is about transversely coplanar with the drilling track and the working track, the secondary track being transversely movable with the working track so that the secondary track is disposed in the second housing when the working track is in the first position and is aligned with the drilling track when the working track is in the second position; and power means for pivoting the secondary track from the skewed position to the in-line position and transversely moving the secondary track in the in-line position and the working track to the second position of the working track; and for transversely moving the working track in the second position and the secondary track in the in-line position to the first position of the working track and pivoting the secondary track from the in-line position to the skewed position.

9. Apparatus of claim 8 in which the power means comprises:

an actuator having an extendable and retractable ram connected between the working track and the second housing; and wherein the power means pivots the second housing and the secondary track from the skewed position to the in-line position and transversely moves the secondary track in the in-line position and the working track to the second position of the working track by extending the ram; and wherein the power means transversely moves the working track in the second position and the secondary track in the in-line position to the first position of the working track, and pivots the second housing and the secondary track from the in-line position to the skewed position by retracting the ram.

10. Apparatus of claim 9, comprising:

stop means for stopping pivotal motion of the secondary track at the in-line position when the secondary track is being pivoted from the skewed position to the in-line position.

11. Apparatus of claim 9, comprising:

anti-pivot means for preventing pivotal motion of the secondary track when the secondary track is in the in-line position.

12. Apparatus of claim 9, comprising:

latch means for preventing transverse motion of the working track when the secondary track is not in the in-line position.

13. Apparatus of claim 9:

wherein the working track and secondary track are located at the lower end of the drilling track.

14. Method of moving track-guided equipment to and from a track, such as a drilling track extending along the length of the derrick of a subterranean drilling rig, in which the equipment is movable about axially along the length of the drilling track between the upper end and the lower end of the drilling track, the method comprising:

connecting a working track to the derrick so that the working track is transversely movable between a first position in which the working track is aligned with the drilling track and a second position in which the working track is transversely displaced from alignment with the drilling track;

connecting a secondary track to the working track so that the secondary track is pivotable between a skewed position in which the secondary track is not transversely coplanar with the drilling track and the working track and an in-line position in which the secondary track is about transversely coplanar with the drilling track and the working track, and so that the secondary track is transversely movable with the working track and is aligned with the drilling track when the working track is in the second position;

pivoting the secondary track from the skewed position to the in-line position and transversely moving the secondary track in the in-line position and the working track to the second position of the working track so that the equipment may be lowered from the drilling track onto the secondary track; and transversely moving the working track in the second position and the secondary track in the in-line position to the first position of the working track and pivoting the secondary track from the in-line position to the skewed position in order to remove the equipment from the drilling track and align the working track with the drilling track.

15. Method of claim 14 comprising:

connecting an actuator having an extendable and retractable ram between the working track and the secondary track;

extending the ram to pivot the secondary track from the skewed position to the in-line position and transversely move the secondary track in the in-line position and the working track to the second position of the working track; and retracting the ram to transversely move the working track in the second position and the secondary track in the in-line position to the first position of the working track and to pivot the secondary track from the in-line position to the skewed position.

16. Method of claim 15, comprising:

stopping pivotal motion of the secondary track at the in-line position when the secondary track is being pivoted from the skewed position to the in-line position.

17. Method of claim 15, comprising:

preventing pivotal motion of the secondary track when the secondary track is in the in-line position.

18. Method of claim 15, comprising:

preventing transverse motion of the working track when the secondary track is not in the in-line position.

19. Method of claim 15, comprising:

connecting a first housing of an articulated guideway to the derrick;

pivotably connecting a second housing of the articulated guideway to the first housing of the articulated guideway; and movably disposing the working track in the first housing and movably disposing the secondary track in the second housing in the first position of the working track.

20. Method of claim 15, comprising:

locating the working track and secondary track at the lower end of the drilling track.

* * * * *

UNITED STATES PATENT AND TRADEMARK OFFICE

CERTIFICATE OF CORRECTION

PATENT NO. : 5,211,251

DATED : May 18, 1993

INVENTOR(S) : Joseph R. Woolslayer

It is certified that error appears in the above-identified patent and that said Letters Patent is hereby corrected as shown below:

Col. 2, line 58, change "5,038,87" to --5,038,871--.

Col. 5, line 59, change "FIG." to --FIG. 1--.

Col. 7, line 23, change "position 5" to --position 52-- and change "move" to --moves--.

Col. 8, line 25, change "housing 6" to --housing 66--.

Col. 12, line 61, change "track 8" to --track 38--.

Col. 13, line 9, after "24." insert -- In the preferred embodiment, the transverse stop 186 is placed in--.

Signed and Sealed this

Eighteenth Day of January, 1994

*Attest:*

Bruce Lehman

BRUCE LEHMAN

*Attesting Officer*

*Commissioner of Patents and Trademarks*